US005627556A

United States Patent [19]

Kwon et al.

[11] Patent Number: 5,627,556

[45] Date of Patent: May 6, 1997

[54] CIRCUIT FOR DRIVING ALTERNATING CURRENT THIN FILM ELECTROLUMINESCENCE DEVICE USING RELATIVE POTENTIAL DIFFERENCE

[75] Inventors: Yong-Moo Kwon; Myung Hwan Oh, both of Seoul, Rep. of Korea

[73] Assignee: Korea Institute of Science and Technology, Rep. of Korea

[21] Appl. No.: 326,548

[22] Filed: Oct. 20, 1994

[30] Foreign Application Priority Data

Dec. 8, 1993 [KR] Rep. of Korea ..... 26934/1993

[51] Int. Cl.[6] ..... G09G 3/30

[52] U.S. Cl. ..... 345/76; 345/79; 345/78; 345/77; 345/211; 345/212; 345/209; 345/52

[58] Field of Search ..... 345/76–79, 211–212, 345/209, 52

[56] References Cited

U.S. PATENT DOCUMENTS 5,093,654 3/1992 Swift et al. ..... 345/76

5,206,631 4/1993 Yamamoto et al. ..... 345/79

*Primary Examiner*—Richard Hjerpe

*Assistant Examiner*—Vui T. Tran

*Attorney, Agent, or Firm*—Scully, Scott, Murphy and Presser

[57] ABSTRACT

A circuit for driving an AC TFEL device which is a complete solid luminescence element, capable of generating positive and negative AC voltages from a single DC voltage by utilizing a relative potential difference and thereby providing a compact voltage supply unit required for driving the AC TFEL device. A circuit is also provided which is constructed to reduce the number of operating voltages required in the refresh drive method and the scan inversion symmetric drive method upon driving the matrix of the AC TFEL device by using a relative potential generating circuit. By employing such a circuit, it is possible to simply provide a voltage supply circuit required in a portable display system using the AC TFEL device and supply a voltage required for the refresh driving and the scanning sequence inversion driving by using only one clock control signal.

3 Claims, 15 Drawing Sheets

FIG.8A CLOCK
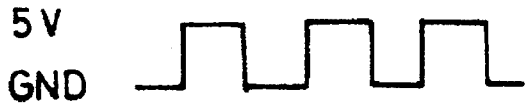
FIG.8B $V_a$
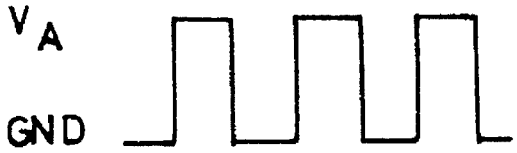
FIG.8C $V_b$
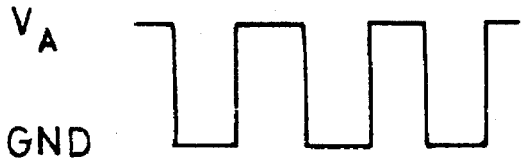
FIG.8D $(V_b - V_a)$
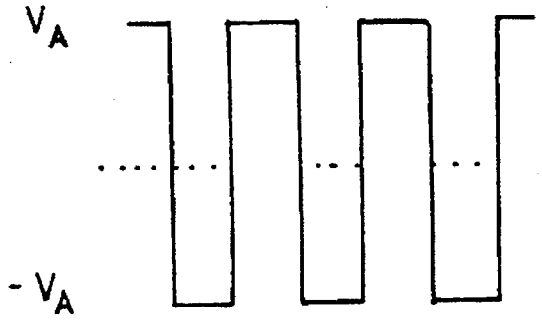

CLOCK
Vclock
GND
1/f

Vth
GND

Vth
GND
DELAY TIME OF R31 C31
IN FIG.12

Vg
Vth
GND

Vth+Vm
GND

Vth+Vm
GND

Vc
Vth+Vm
GND

Vth+Vm
GND

Vth+Vm
GND

Vr
Vth+Vm
GND

CIRCUIT FOR DRIVING ALTERNATING CURRENT THIN FILM ELECTROLUMINESCENCE DEVICE USING RELATIVE POTENTIAL DIFFERENCE

BACKGROUND OF THE INVENTION

1. Field of the Invention

The present invention relates to a driver for an alternating current thin film electro luminescence (AC TFEL) device, and more particularly to a circuit for driving an AC TFEL device, capable of generating positive and negative voltages required to drive the AC TFEL device which is a positive solid luminescence device of a planar display device constituting an important part of a hanging television receiver or a portable computer and exhibits a superior endurance against surroundings, a large view angle and a high response speed.

2. Description of the Prior Art

FIG. 1 is an electrically equivalent circuit of an AC TFEL device. As shown in FIG. 1, an AC voltage is applied to the AC TFEL device, for driving of the AC TFEL device. For driving the AC TFEL device, actually, DC pulses of positive polarity and negative polarity are alternatingly applied to the AC TFEL device. For luminescence of the AC TFEL device, the pulses should exceed the threshold voltage Vth of about 135 to 175 V. Brightness of the AC TFEL device is adjusted by a modulation voltage Vm of about 40 to 60 V. The AC TFEL device has a behavior that it emits light when it receives voltage pulses of opposite polarities.

In a display device using such an AC TFEL device, a matrix drive system is generally utilized. As a method for driving the AC TFEL device, a refresh drive method and a symmetric drive method are mainly used. The refresh method is the method wherein scanning pulses are applied row by row and after the scanning of one frame is completed, refresh pulses having an opposite polarity to that of the scanning pulses are applied to all rows simultaneously so as to discharge the charge accumulated in each pixel. The refresh method provides a characteristic that for one frame, light is emitted two times, namely, one time when the scanning pulses are applied and the other time when the refresh pulses are applied.

However, the refresh drive method encounters a problem of residual DC voltage difference among pixels because the interval of pulses applied to each pixel is asymmetric. Due to such a problem, the refresh drive method has a disadvantage that a latent image is generated by the lapse of use time.

The symmetric drive method has been proposed to solve the above-mentioned problem encountered in the refresh drive method. This method is the method wherein the polarity of scanning pulses is changed every time when a change of frame occurs. In accordance with the symmetric drive method, the interval of pulses applied to the pixels is uniform. This solves the problem of residual DC voltage difference encountered in the refresh drive method. However, the symmetric drive method has a disadvantage of a degradation in brightness, as compared with the refresh drive method. This is because for one frame, light is emitted only one time in accordance with the symmetric drive method.

Meanwhile, there has been also proposed a scan inversion symmetric drive method for solving the problem of residual DC voltage difference and yet maintaining a brightness as obtained in the refresh drive method. This method is disclosed in European Paten No. EP 295852.

The scan symmetric drive method is similar to the refresh drive method, except that the scanning sequence of row electrodes is inverted every time when a change of frame occurs. In accordance with the scan inversion symmetric drive method, for a frame, scanning pulses are applied in a sequence from the first row to the last row. For the next frame, scanning pulses are applied in a sequence from the last row to the first row. In accordance with the scan inversion symmetric drive method, residual DC voltages respectively applied to the pixels become uniform by inverting the scanning sequence of row electrodes for every frame change. The refresh drive method and the scanning sequence inversion drive method require an open-drain circuit at the side of rows and a push-pull circuit at the side of columns. On the other hand, the symmetric drive method requires push-pull circuits at both the side of rows and the side of columns.

Now, the basic concept of the refresh drive method upon driving an AC TFEL matrix will be described.

Cross areas of rows and column electrodes serve as electroluminescence (EL) pixels. Upon scanning of row electrodes, a voltage pulse of −Vth is applied to the row electrodes. To column electrodes, a modulation voltage Vm is applied for "ON" pixels, while zero voltage is applied for "OFF" pixels.

As a result, the pixels to be at the ON state receive the voltage of −(Vth+Vm), so that they may emit light. On the other hand, the pixels to be at the OFF state receives only the voltage of −Vth, so that they may not emit light. After completion of the scanning of all row electrodes for one frame, a voltage of +(Vth+Vm) is applied to all the row electrodes as a refresh pulse, while zero voltage is applied to all the column electrodes.

At this time, all pixels receive the voltage of +(Vth+Vm). This means that the voltage pulse having the opposite polarity to that upon the scanning is applied. It is noted that by virtue of the charge movement amount of the pixels upon refreshing, the pixels which were at ON state by the voltage of −(Vth+Vm) applied thereto upon the scanning are still maintained at ON state, while the pixels which were at OFF state by the voltage of −Vth applied thereto upon the scanning are still maintained at OFF state.

FIG. 2 is a circuit diagram of a matrix driving circuit operating in accordance with the conventional refresh drive method and scan inversion symmetric drive method. As shown in FIG. 2, the circuit includes three voltage supply units 1, 2 and 3, and a voltage selection circuit 4 adapted to select voltages respectively required for a column-driving integrated element upon refreshing and scanning.

In driving of the conventional TFEL device, three voltages, +(Vth+Vm), −Vth and +Vm should be used, in addition to a voltage for driving a logic circuit, in order to accomplish the AC TFEL refresh drive method and the scan inversion symmetric drive method. For supplying these voltages, a voltage supply circuit which is constituted by a switching regulator circuit is required. However, the use of such a voltage supply circuit results in a difficulty to achieve compactness and lightness of electronic devices. Furthermore, there is a problem of a loss of energy in a power supply unit. The switching regulator also causes a switching noise problem that makes it difficult to embody desired electronic devices.

SUMMARY OF THE INVENTION

Therefore, an object of the invention is to provide a circuit for driving an AC TFEL device utilizing a relative potential difference, capable of reducing the number of operating voltages required to realize the refresh drive method and the scan inversion symmetric drive method where a portable display system is constructed using the AC TFEL device.

Another object of the invention is to provide a circuit for driving an AC TFEL device utilizing a relative potential difference, capable of providing a drive voltage by utilizing the relative potential difference between corresponding column and row electrodes of the AC TFEL device required to emit light upon driving the AC TFEL device.

Another object of the invention is to provide a circuit for driving an AC TFEL device utilizing a relative potential difference, capable of generating a voltage required for the refresh driving and the scan inversion symmetric driving by using only one control clock signal and thereby simply constructing a control signal for a relative potential difference generating circuit.

Another object of the invention is to provide a circuit for driving an AC TFEL device utilizing a relative potential difference, capable of generating a refresh pulse providing a desired refresh period by using RC delay elements and diodes.

In accordance with one aspect, the present invention provides a circuit for driving alternating current thin film electroluminescence device using a relative potential difference, comprising: a first voltage supply unit for generating a voltage corresponding to the sum of a luminescence threshold voltage and a modulation voltage; a second voltage supply unit for generating the luminescence threshold voltage; a relative potential difference generating unit for directly receiving an input clock signal in the delayed and inverted form and switching the output voltages from the first and second voltage supply units to perform AND and OR operations for the voltages, thereby generating a column electrode voltage, a reference voltage and a row electrode voltage; a pair of drive integrated elements having a push-pull structure and respectively adapted to receive the column row electrode voltage and the reference voltage from the relative potential difference generating unit, perform a push-pull operation in accordance with an input gate signal, and thereby output the column electrode voltage; and another drive integrated element having an open-drain structure and adapted to receive the row electrode voltage from the relative potential difference generating unit and output the received row electrode voltage in accordance with the input gate signal.

In accordance with another aspect, the present invention provides a circuit for driving an alternating current thin film electroluminescence device using a relative potential difference, comprising: a first voltage switching circuit for switching a drive voltage in accordance with an input clock signal and thereby amplifying it to a level ranging from the drive voltage to a ground voltage; an inverter for inverting the input clock signal; and a second voltage switching circuit for switching the drive voltage in accordance with an output signal from the inverter and amplify it to a level ranging from the drive voltage to the ground voltage to output a voltage inverted from an output signal from the first voltage switching circuit so that output voltages of the voltage switching circuits are switched to generate their differential voltage.

BRIEF DESCRIPTION OF THE DRAWINGS

The above and other objects, features and advantages of the present invention will be more clearly understood from the following detailed description taken in conjunction with the accompanying drawings, in which:

FIGS. 8A to 8D are waveform diagrams of signals generated from various parts of the circuit shown in FIG. 7, respectively;

FIGS. 15A to 15C are waveform diagrams explaining generation of a refresh drive signal by a circuit for controlling gates of row drive integrated elements, wherein FIG. 15A shows a control signal for a row drive integrated element, FIG. 15B shows a voltage applied to a row drive electrode, and FIG. 15C shows a voltage applied to a column drive integrated element.

DETAILED DESCRIPTION OF THE PREFERRED EMBODIMENTS

Figure 5:
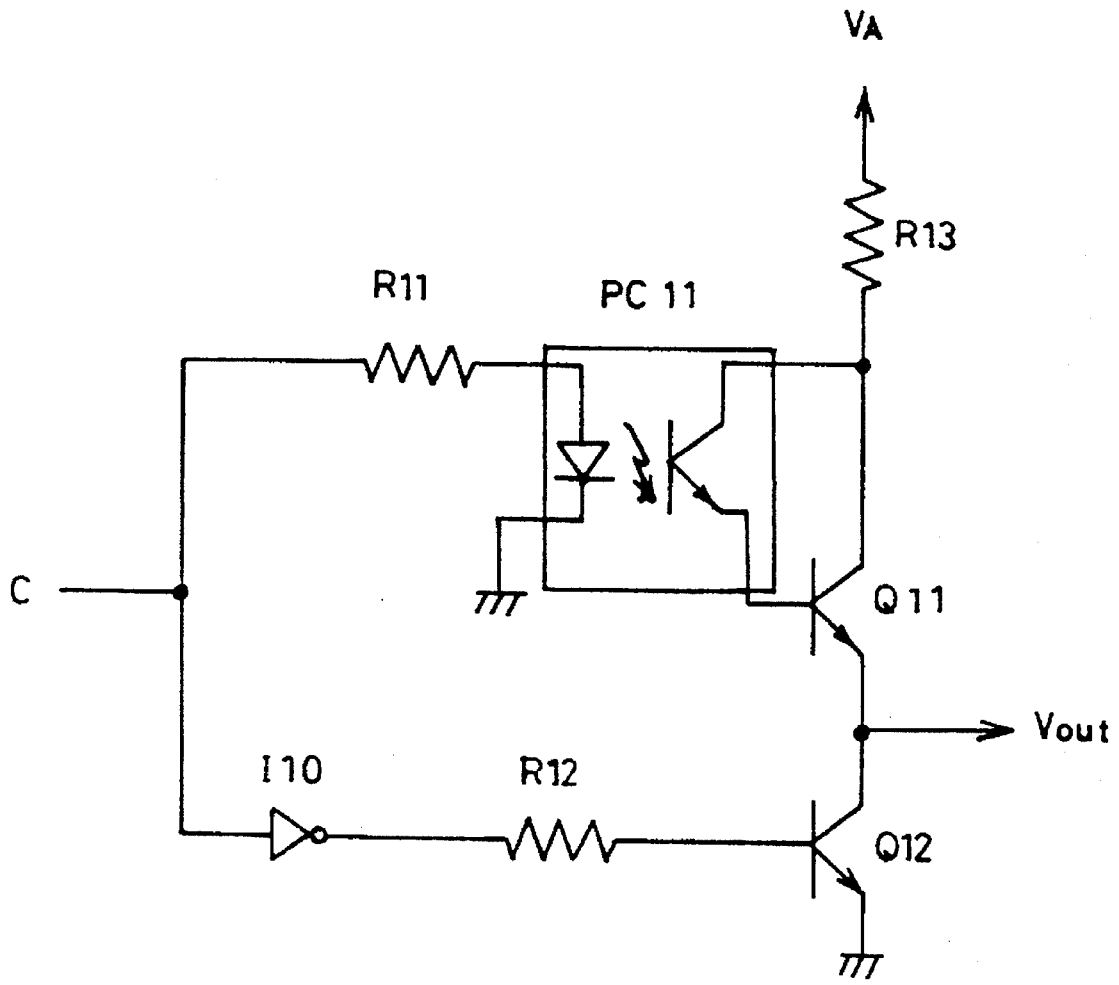
FIG. 5 is a circuit diagram illustrating a voltage switching circuit in accordance with the present invention.

FIG. 5 is a circuit diagram illustrating a voltage switching circuit utilizing transistors in accordance with the present invention. As shown in FIG. 5, the voltage switching circuit includes a photo coupler $PC_{11}$ switched between ON and OFF states in accordance with an input clock signal, an inverter $I_{10}$ adapted to invert the input clock signal, and a pair of transistors $Q_{11}$ and $Q_{12}$ respectively switched between ON and OFF states by output signals from the photo coupler $PC_{11}$ and the inverter $I_{10}$ while outputs voltages of $V_A$ to 0 V synchronized with the input clock signal. Operation of the voltage switching circuit will now be described, in conjunction with FIGS. 6A and 6B.

Figure 6A:
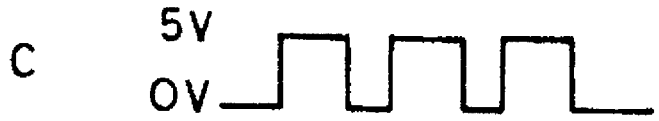
FIGS. 6A and 6B are waveform diagrams of input and output signals of the voltage switching circuit shown in FIG. 5.
Figure 6B:
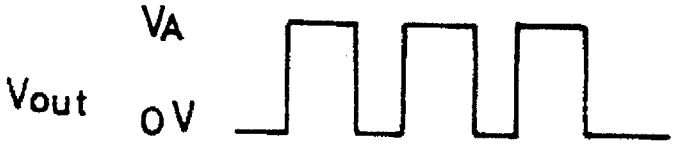

As a control signal from an input stage C shown in FIG. 6A is applied to the base of transistor $Q_{12}$ via the inverter $I_{10}$ and a resistor $R_{12}$ and to the photo coupler $PC_{11}$ and then the base of transistor $Q_{11}$ via the resister $R_{11}$, the photo coupler $PC_{11}$ and the transistor $Q_{11}$ are turned on at high intervals of the control signal. As the photo coupler $PC_{11}$ and the transistor $Q_{11}$ are turned on, a voltage $V_A$ from a voltage supply source is sent to an output stage $V_{OUT}$ via a resister $R_{13}$ and the transistor $Q_{11}$. At the high intervals of the control signal, accordingly, the transistor $Q_{11}$ is at ON state, while the transistor $Q_{12}$ is at OFF state. As a result, an level-up output signal switched between 0 V and $V_A$ is generated at the output stage $V_{OUT}$, as shown in FIG. 6B.

Figure 7:
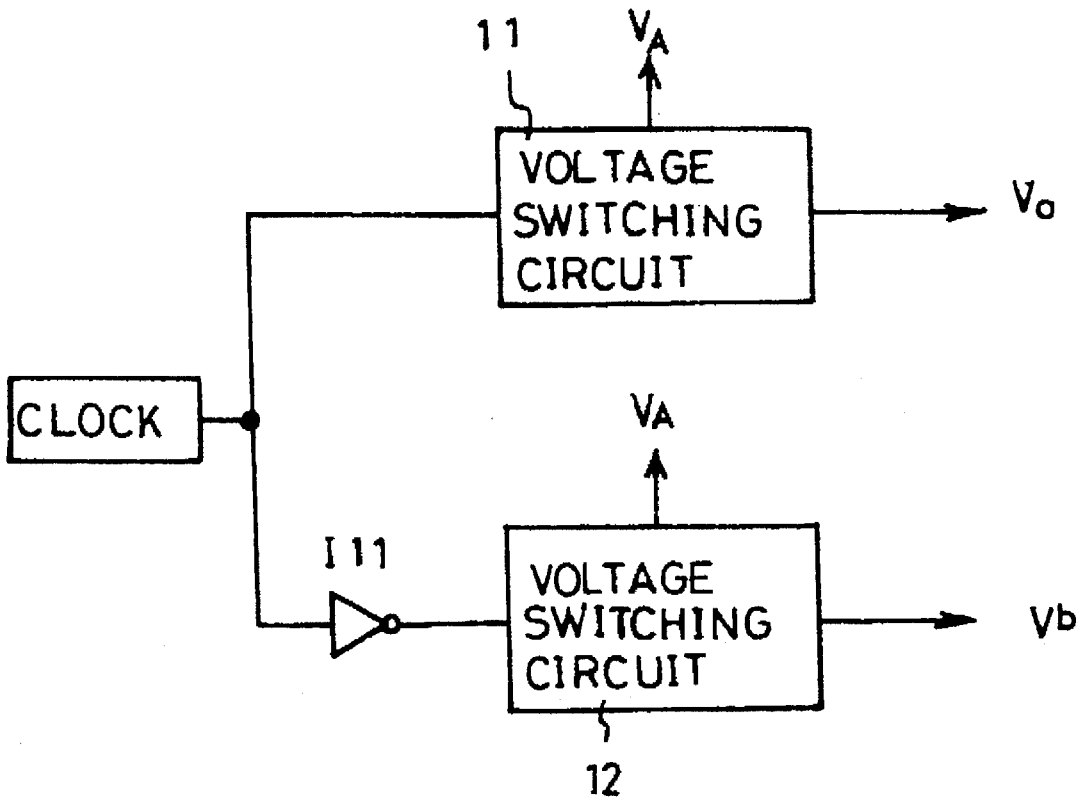
FIG. 7 is a circuit diagram illustrating a voltage generating circuit utilizing a single DC voltage to generate AC voltages for positive and negative electrodes in accordance with the present invention.

FIG. 7 is a circuit diagram illustrating a voltage generating circuit utilizing a single DC voltage $V_A$ and a pair of voltage switching circuits shown in FIG. 5 to generate a voltage of $V_A$ to $-V_A$ in accordance with the present invention. As shown in FIG. 7, the voltage generating circuit includes a voltage switching circuit 11 adapted to switch the drive voltage $V_A$ in accordance with an input clock signal and amplify the voltage to a level of $V_A$ to a ground level GND, an inverter $I_{11}$ adapted to invert the input clock signal, and another voltage switching circuit 12 adapted to switch the drive voltage $V_A$ in accordance with an output signal from the inverter $I_{11}$ and amplify the voltage to a level of $V_A$ to GND to output a voltage inverted from an output signal from the switching circuit 11. By switching output voltages of the voltage switching circuits 11, the voltage generating circuit obtains a voltage of $V_A$ to $-V_A$ corresponding to the difference between the output voltages. Operation of the voltage generating circuit will now be described, in conjunction with FIG. 8A to 8D.

Figure 1:
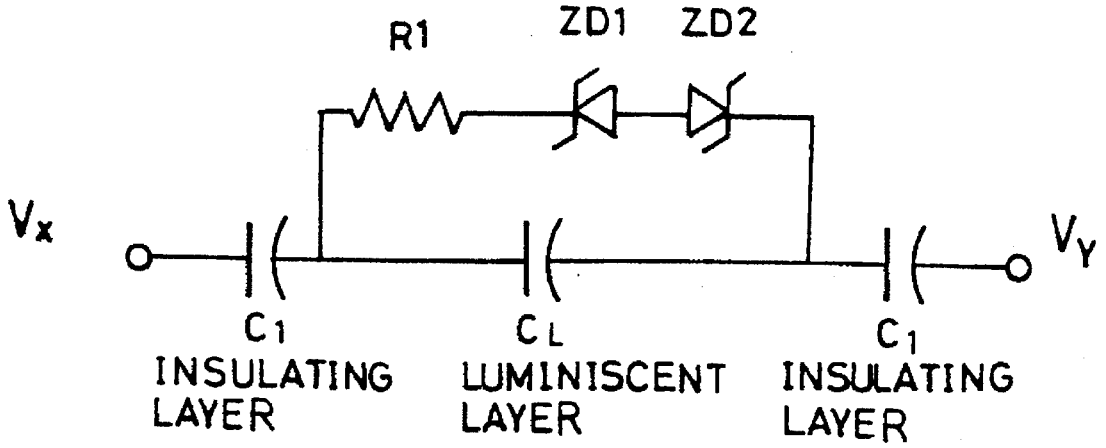
FIG. 1 PRIOR ART
FIG. 1 is a circuit diagram illustrating an electrically equivalent circuit of an AC TFEL device.
Figure 2:
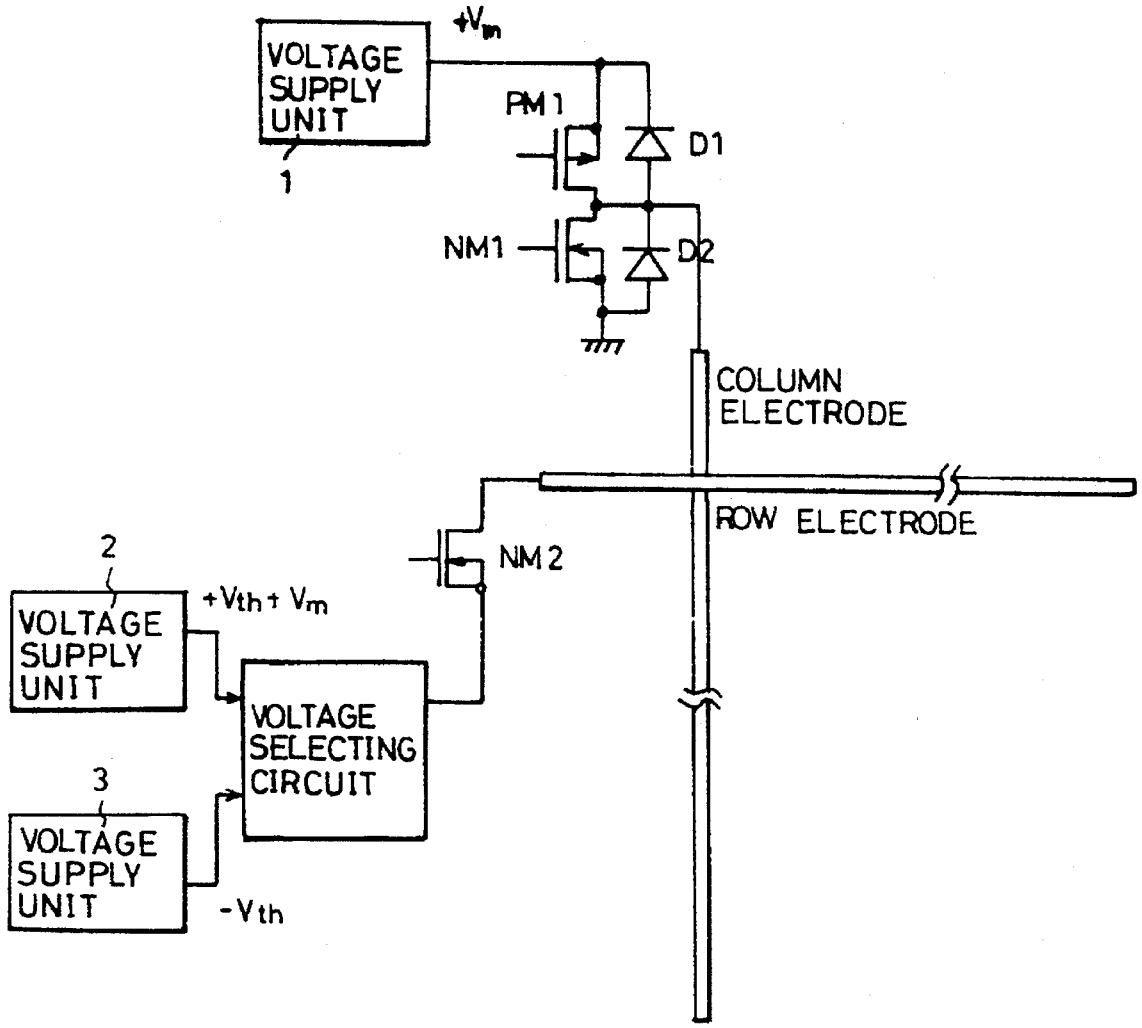
FIG. 2 PRIOR ART
FIG. 2 is a circuit diagram of a matrix driving circuit operating in accordance with the conventional refresh drive method and scan inversion symmetric drive method.
Figure 3:
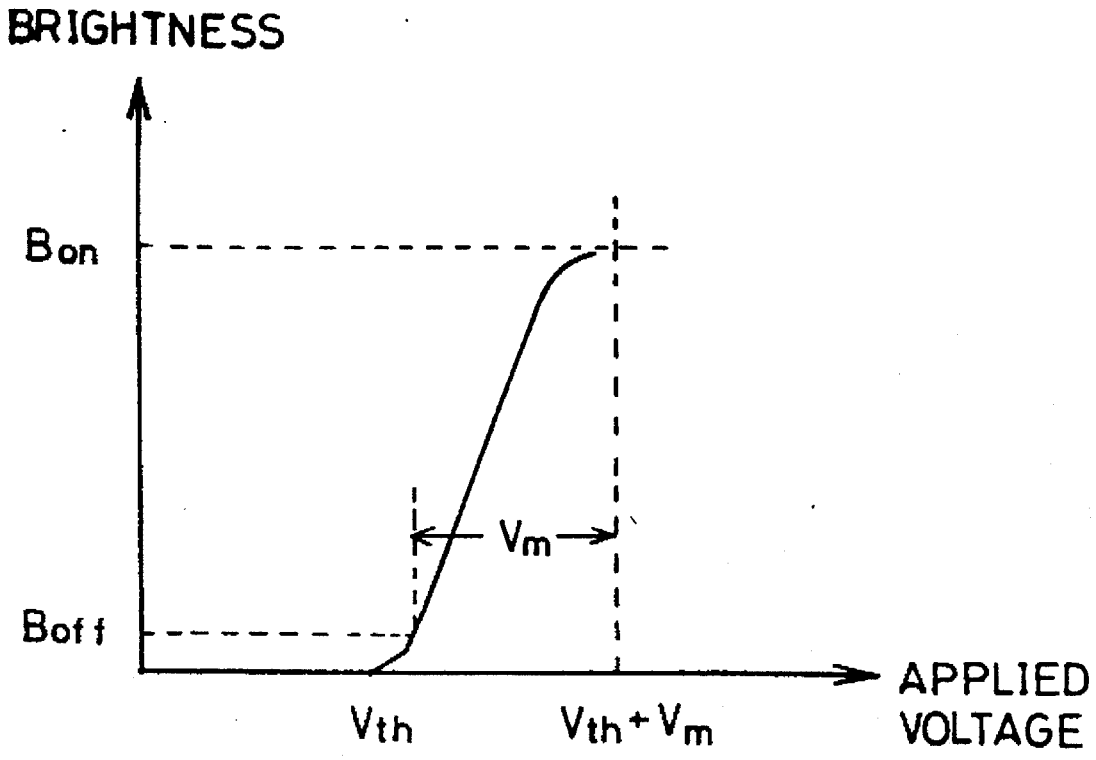
FIG. 3 PRIOR ART
FIG. 3 is a diagram illustrating a brightness characteristic of the AC TFEL device depending on applied voltage.
Figure 4A:
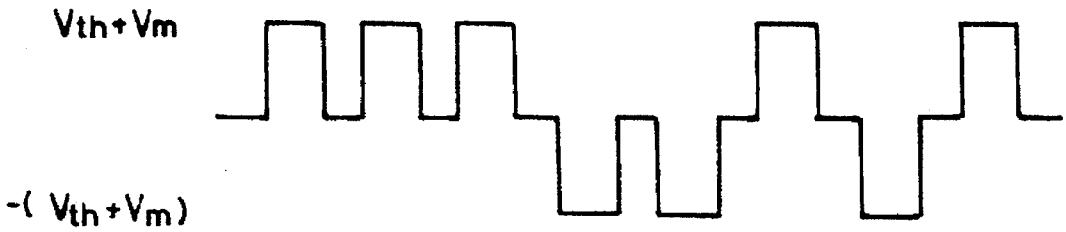
FIG. 4A PRIOR ART
FIGS. 4A and 4B are diagrams illustrating a brightness characteristic of the AC TFEL device depending on applied voltage pulse.
Figure 4B:
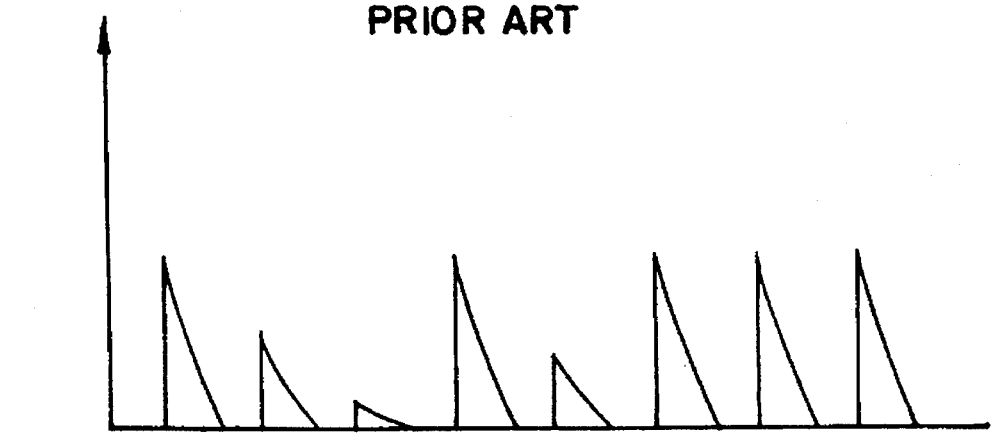
FIG. 4B PRIOR ART

When a clock signal shown in FIG. 8A is applied to the voltage switching circuit 11 having the construction shown in FIG. 5, a level-up voltage Va switched between $V_A$ and GND is generated from the voltage switching circuit 11, as shown in FIG. 8B. The clock signal is also applied to the inverter $I_{11}$ which, in turn, inverts the received clock signal. The inverted clock signal is then sent to the voltage switching circuit 12 having the construction shown in FIG. 5. Upon receiving the inverted clock signal, the voltage switching circuit 12 generates a voltage Vb inverted from the output voltage Va. As a result, the voltage generating circuit obtains a level-up voltage resulted from a subtraction of the voltage Va from the voltage Vb. The obtained voltage is shown in FIG. 8D.

Where the AC voltage Va from the voltage switching circuit 11 and the AC voltage Vb from the voltage switching circuit 12 are applied to stages Vx and Vy of the AC TFEL device shown in FIG. 1, respectively, a luminescent layer $C_L$ of the AC TFEL device emits light.

Figure 9:
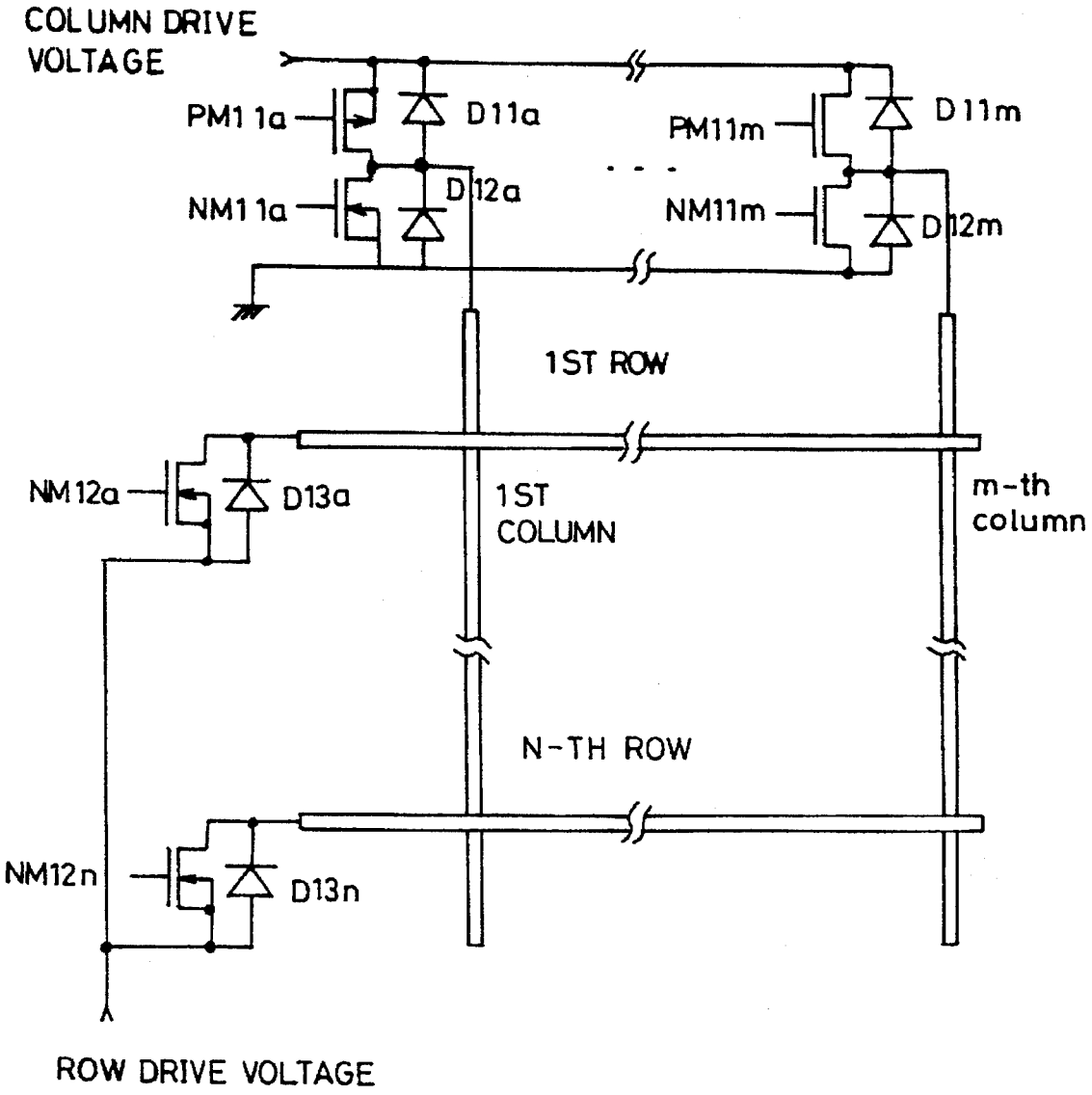
FIG. 9 PRIOR ART
FIG. 9 is a circuit diagram illustrating a conventional circuit for driving a matrix of the AC TFEL device.

FIG. 9 is a circuit diagram illustrating a matrix driving circuit utilizing the refresh drive method. In accordance with the refresh drive method, a plurality of drive integrated elements $NM_{12a}$ . . . $NM_{12n}$ having an open-drain structure are used for row electrodes, respectively, whereas a plurality of drive integrated element pairs $PM_{11a}$-$NM_{11a}$ . . . $PM_{11m}$-$NM_{11m}$ having a push-pull structure are used for column electrodes, respectively. Overlapping areas of the row and column electrodes serve as EL pixels, respectively. Turn-on/off of the pixels is determined by controlling the row and column driving elements. Operation of the matrix driving circuit will now be described, in conjunction with FIGS. 10A to 10F.

FIGS. 10A to 10F are waveform diagrams explaining turn-on/off of pixels achieved by applied voltage pulses in the matrix driving circuit of FIG. 9 in accordance with the refresh drive method. In the matrix of FIG. 9, only one of the row electrodes is selected upon every driving of the matrix. To the selected electrode, a voltage of −Vth is applied. At this time, turn-on/off of the pixel positioned at a position where the pixel crosses a row electrode selected by a voltage applied to the column electrodes is determined.

Figure 10A:
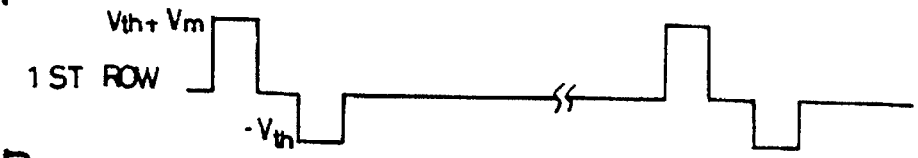
FIG10A PRIOR ART
FIGS. 10A to 10F are waveform diagrams explaining a refresh driving of the AC TFEL device.
Figure 10B:
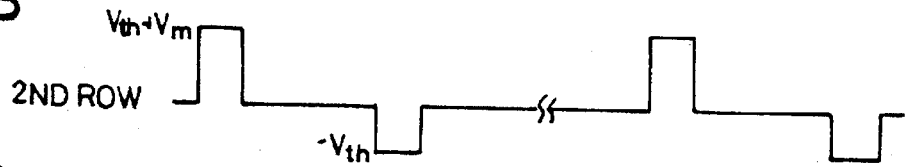
FIG.10B PRIOR ART
Figure 10C:
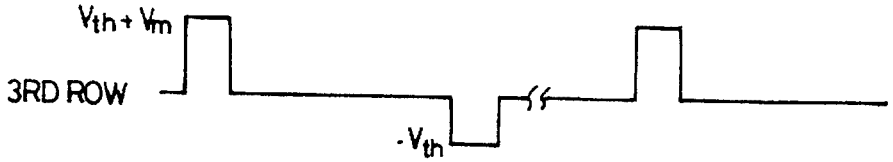
FIG.10C PRIOR ART
Figure 10D:
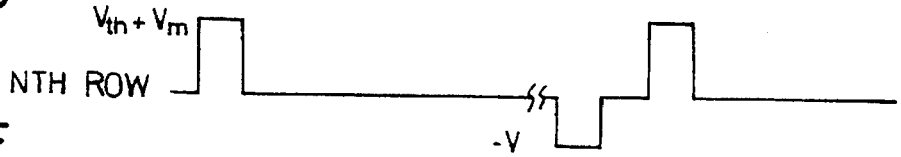
FIG.10D PRIOR ART
Figure 10E:
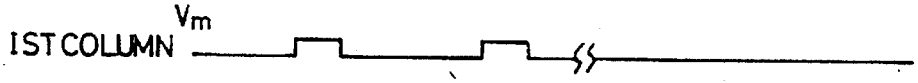
FIG.10E PRIOR ART
Figure 10F:
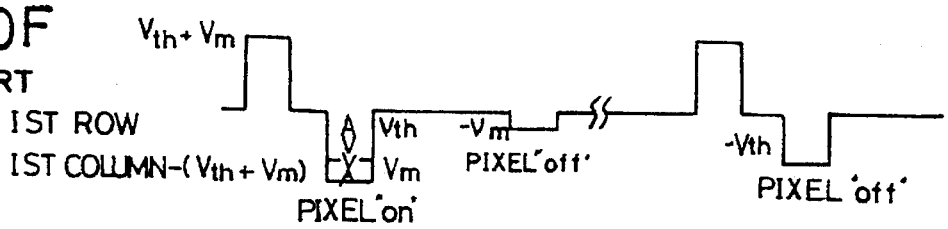
FIG.10F PRIOR ART

For example, where the voltage of −Vth and the voltage of +Vm are applied to a selected row electrode of the first row and a selected column electrode of the first column, respectively, as shown in FIG. 10F, a voltage of −(Vth+Vm) is applied to the two electrodes of the AC TFEL device, thereby enabling a corresponding pixel to emit light. However, where only one of the two electrodes receives its corresponding voltage, the pixel does not emit light. When the scanning is completed for n rows, a refresh pulse of +(Vth+Vm) is applied to all the rows. At this time, a voltage of zero volt is applied to all column electrodes. It is noted that the pixels selected to emit light by the amount of transferred charge of the AC TFEL device for the previous scanning period emit light, while other pixels do not emit light.

Figure 11:
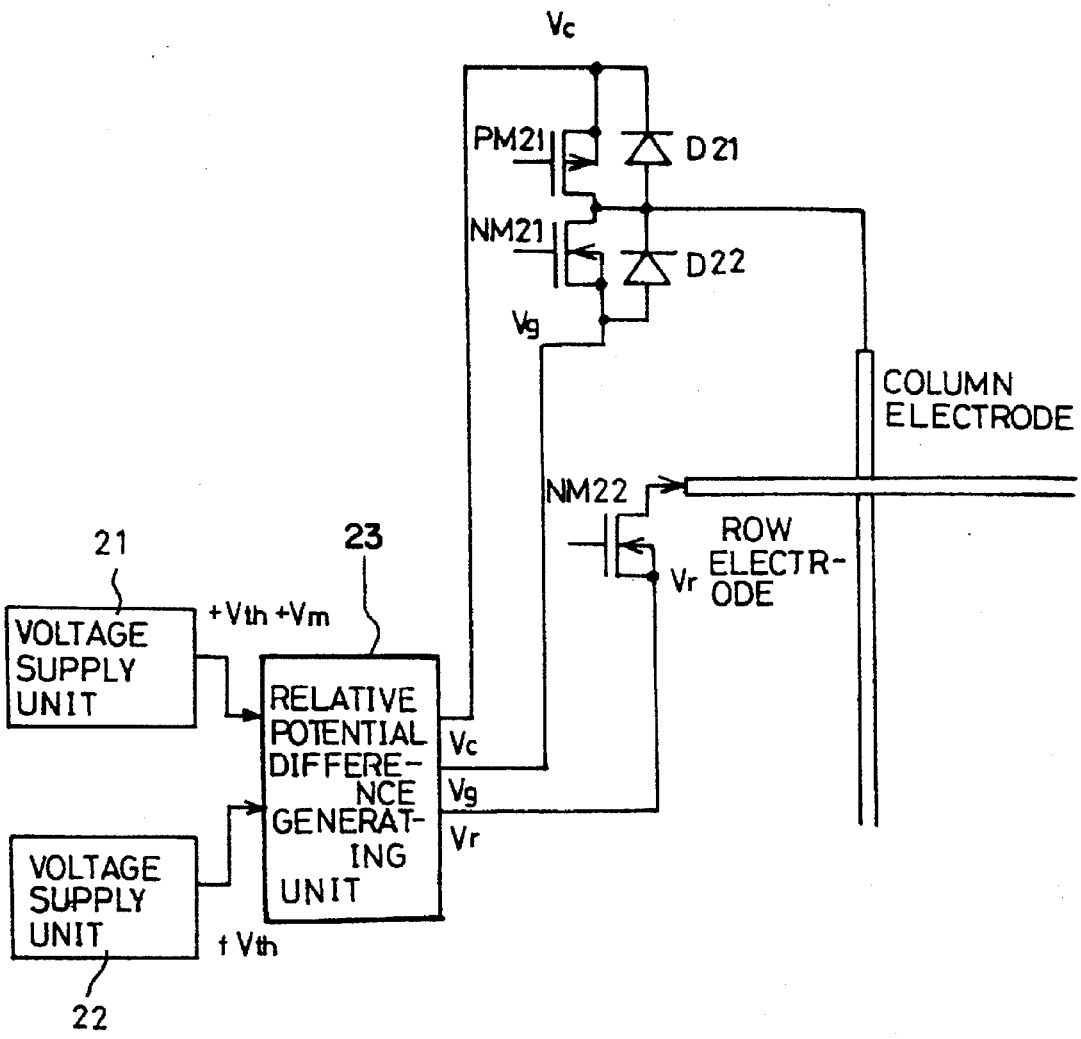
FIG. 11 is a circuit diagram illustrating an AC TFEL device utilizing the refresh drive method using a relative potential difference and the scan inversion symmetric drive method in accordance with the present invention.

FIG. 11 is a circuit diagram illustrating an AC TFEL device utilizing the refresh drive method using a relative potential difference and the scan inversion symmetric drive method in accordance with the present invention. As shown in FIG. 11, the AC TFEL device includes a voltage supply unit 21 for generating a voltage of +(Vth+Vm) corresponding to the sum of a luminescence threshold voltage +Vth and a modulation voltage Vm, another voltage supply unit 22 for generating the luminescence threshold voltage +Vth, and a relative potential difference generating unit 23 for directly receiving an input clock signal in the delayed and inverted form and switching the output voltage of +(Vth+Vm) from the voltage supply unit 21 and the output voltage of +Vth from the voltage supply unit 22 to perform AND and OR operations for the voltages, thereby generating a column electrode voltage Vc, a reference voltage Vg and a row electrode voltage Vr. The AC TFEL device further includes a pair of drive integrated elements $PM_{21}$ and $NM_{21}$ having a push-pull structure and respectively adapted to receive the column electrode voltage Vc and the reference voltage Vg from the relative potential difference generating unit 23, perform a push-pull operation in accordance with an input gate signal, and thereby output the column electrode voltage Vc. Another drive integrated element $NM_{22}$ is also provided which has an open-drain structure. The drive integrated element $NM_{22}$ serves to receive the row electrode voltage Vr from the relative potential difference generating unit 23 and output the received row electrode voltage Vr in accordance with the input gate signal.

As apparent from the above description, the AC TFEL device shown in FIG. 11 is adapted to supply three voltages required to perform the refresh drive by employing two voltage supply units and utilizing the relative potential difference between the two voltage supply units. That is, the voltage supply unit 21 outputs the voltage of +(Vth+Vm), while the voltage supply unit 22 outputs the voltage of +Vth. The relative potential difference generating unit 23 generates the column electrode voltage Vc, the reference voltage Vg and the row electrode voltage Vr using the output voltages +(Vth+Vm) and +Vth from the voltage supply units 21 and 22.

The column electrode voltage Vc from the relative potential difference generating unit 23 is applied to a source of the drive integrated element $PM_{21}$ which has the push-pull structure and is a PMOS transistor. On the other hand, the reference electrode voltage Vg from the relative potential difference generating unit 23 is applied to a source of the drive integrated element $NM_{21}$ connected in series to the PMOS transistor $PM_{21}$. The drive integrated element $NM_{21}$ is an NMOS transistor. Therefore, the column electrode voltage is output at the common drain node between the drain of the PMOS transistor $PM_{21}$ and the drain of the NMOS transistor $NM_{21}$ in accordance with gate signals from the PMOS transistor $PM_{21}$ and NMOS transistor $NM_{21}$.

Meanwhile, the row electrode voltage Vr from the relative potential difference generating unit 23 is applied to a source of the drive integrated element $NM_{22}$ which has the push-pull structure and is a NMOS transistor. Therefore, the row electrode voltage is output at the drain of the NMOS transistor $NM_{22}$ in accordance with a gate signal from the NMOS transistor $NM_{22}$.

Figure 12:
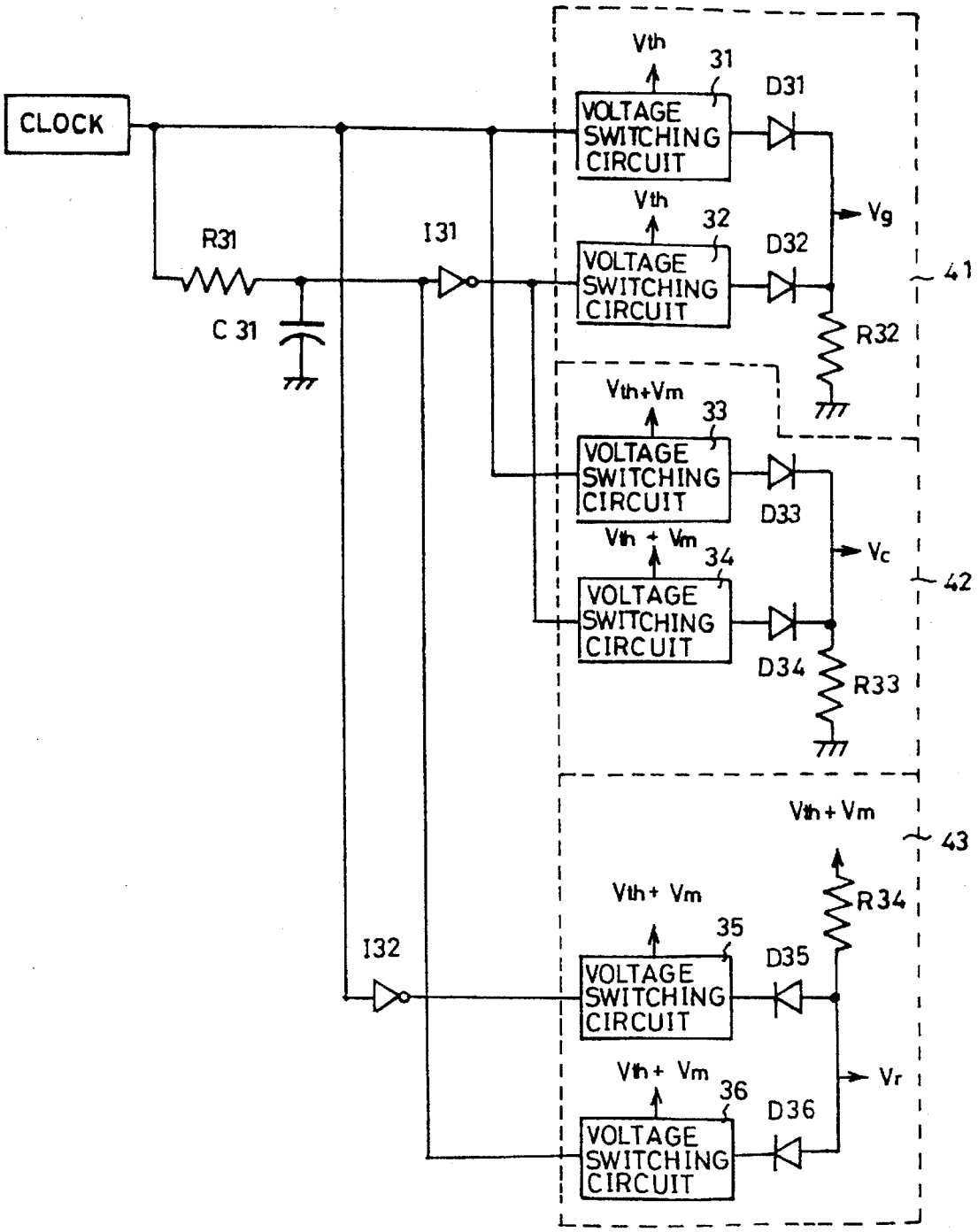
FIG. 12 is a circuit diagram of a voltage generating circuit utilizing a relative potential difference in accordance with the present invention.

FIG. 12 is a circuit diagram of the relative potential difference generating circuit shown in FIG. 11. The relative potential difference generating circuit includes a plurality of voltage switching circuits 31 to 36, a delay circuit based on an RC time constant determined by RC delay elements $R_{31}$ and $C_{31}$, and OR and AND circuits constituted by diodes $D_{31}$ to $D_{36}$ so as to generate a reference voltage Vg, a row electrode voltage Vr and a column electrode voltage Vc. In other words, the relative potential difference generating circuit includes a reference voltage generating circuit 41 constituted by a pair of voltage switching circuits 31 and 32 and a pair of diodes $D_{31}$ and $D_{32}$ respectively connected to the voltage switching circuits 31 and 32 and adapted to generate the reference voltage Vg, a column electrode voltage generating circuit 42 constituted by a pair of voltage switching circuits 33 and 34 and a pair of diodes $D_{33}$ and $D_{34}$ respectively connected to the voltage switching circuits 33 and 34 and adapted to generate the column electrode voltage Vc, and a row electrode voltage generating circuit 43 constituted by a pair of voltage switching circuits 35 and 36 and a pair of diodes $D_{35}$ and $D_{36}$ respectively connected to the voltage switching circuits 35 and 36 and adapted to generate the row electrode voltage Vr. In this circuit, a refresh pulse width is determined by values of the RC delay elements $R_{31}$ and $C_{31}$ of the delay circuit.

Figures 13A, 13B, 13C, 13D, 13E, 13F, 13G, 13H, 13I, 13J:
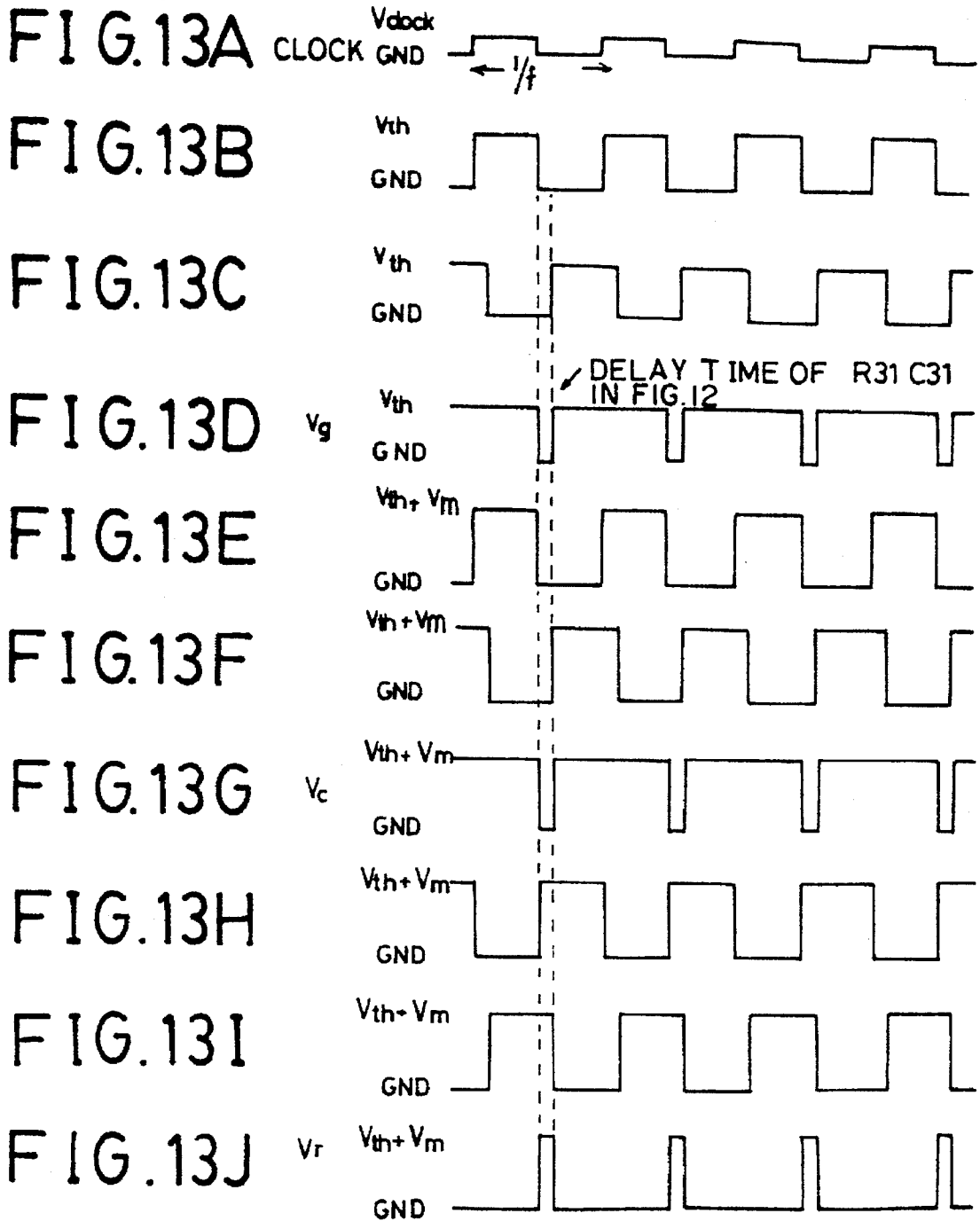
FIGS. 13A to 13J are waveform diagrams of signals generated from various parts of the circuit shown in FIG. 12, respectively.

When a clock signal having the waveform shown in FIG. 13A is applied to the voltage switching circuit 31 which receives a drive voltage of Vth, the voltage switching circuit 31 outputs a voltage shown in FIG. 13B via the diode $D_{31}$. The clock signal is also applied to the delay circuit constituted by the RC delay elements $R_{31}$ and $C_{31}$. The delay circuit delays the received clock signal for a predetermined time and then sends it to an inverter $I_{31}$ coupled to the output of the delay circuit. The inverter $I_{31}$ inverts the received signal and then sends it to the voltage switching circuit 32. Upon receiving the inverted signal from the inverter $I_{31}$, the voltage switching circuit 32 outputs a voltage shown in FIG. 13C via the diode $D_{32}$. As a result, the reference voltage generating circuit 41 outputs a voltage obtained by an OR operation of the diodes $D_{31}$ and $D_{32}$, namely, the reference voltage Vg having the level of Vth to GND shown in FIG. 13D.

On the other hand, the voltage switching circuit 33 receives the clock signal having the waveform shown in FIG. 13A and a drive voltage of Vth+Vm, thereby generating a voltage shown in FIG. 13E. The generated voltage from the voltage switching circuit 33 is output via the diode $D_{33}$. The voltage switching circuit 34 receives the output voltage from the inverter $I_{31}$ and a drive voltage of Vth+Vm, thereby generating a voltage shown in FIG. 13F. The generated voltage from the voltage switching circuit 34 is output via the diode $D_{34}$. As a result, the column electrode voltage generating circuit 42 outputs a voltage obtained by an OR operation of the diodes $D_{33}$ and $D_{34}$, namely, the column electrode voltage Vc having the level of (Vth+Vm) to GND shown in FIG. 13G.

The voltage switching circuit 35 receives a signal having the inverted form from the clock signal by an inverter $I_{32}$ and a drive voltage of Vth+Vm, thereby generating a voltage shown in FIG. 13H. The generated voltage from the voltage switching circuit 35 is output via the diode $D_{35}$. The voltage switching circuit 36 receives the output voltage from the delay circuit constituted by the RC delay elements $R_{31}$ and $C_{31}$ and a drive voltage of Vth+Vm, thereby generating a voltage shown in FIG. 13I. The generated voltage from the voltage switching circuit 36 is output via the diode $D_{36}$. A voltage of Vth+Vm is also applied to the outputs of the voltage switching circuits 35 and 36 via the diodes $D_{35}$ and $D_{36}$. As a result, the row electrode voltage generating circuit 43 outputs a voltage obtained by an AND operation of the diodes $D_{35}$ and $D_{36}$, namely, the row electrode voltage Vr having the level of (Vth+Vm) to GND shown in FIG. 13J.

It is noted that all the voltages Vg, Vr and Vc are controlled by the single clock pulse.

In FIG. 13A, the clock signal has a clock interval of 1/f second, where f represents the number of frames displayed for one second.

Figure 14A:
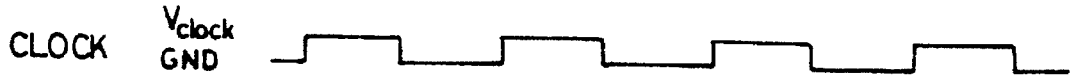
FIGS. 14A to 14C are diagrams illustrating relative waveforms of column and row electrode voltages with reference to a reference voltage.
Figure 14B:
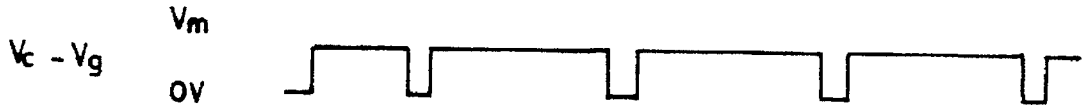
Figure 14C:
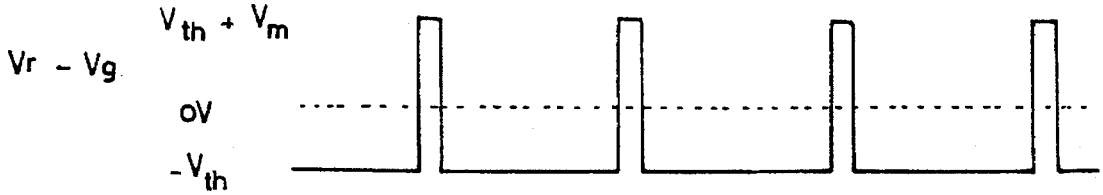

FIGS. 14A to 14C illustrate relative waveforms of the voltages Vc and Vr with reference to the reference voltage Vg when the clock signal is applied. Referring to FIGS. 14A to 14C, it can be found that the voltage of Vc−Vg maintains the level of zero volt for a refresh period and the level of Vm for a scanning period. On the other hand, the voltage of Vr−Vg maintains the level of +(Vth+Vm) for the refresh period and the level of −Vth for the scanning period.

Figure 15A:
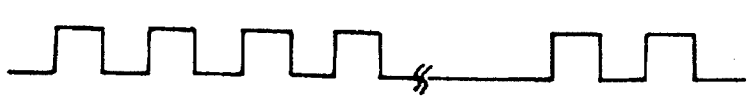
Figure 15B:
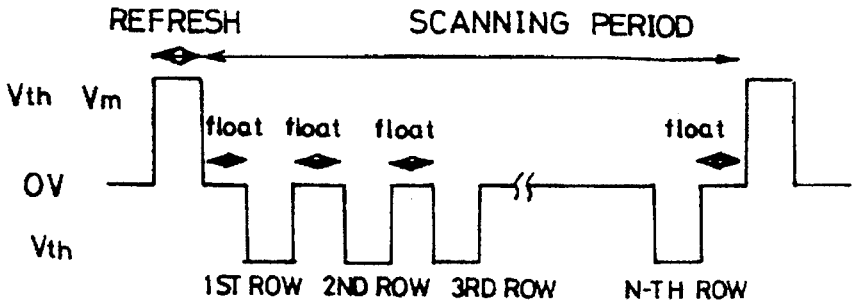
Figure 15C:
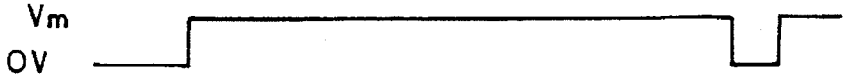

FIGS. 15A to 15C explain the generation of refresh drive signal described in conjunction with FIGS. 10A to 10F by controlling the gates of row drive integrated elements.

As apparent from the above description, the present invention provides a circuit for generating alternating current exhibiting positive and negative polarities from a single direct current voltage by utilizing a relative potential difference. By employing such a circuit, it is possible to provide a compact voltage supply unit required for driving an AC TFEL device. The present invention also provides a circuit constructed to reduce the number of operating voltages required in the refresh drive method and the scan inversion symmetric drive method upon driving the matrix of the AC TFEL device by using a relative potential generating circuit. By employing such a circuit, it is possible to simply provide a voltage supply circuit required in a portable display system using the AC TFEL device. It is also possible to supply a voltage required for the refresh driving and the scanning sequence inversion driving by using only one clock control signal.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A circuit for driving an alternating current thin film electroluminescence device using a relative potential difference, comprising:

a first voltage supply unit for generating a voltage corresponding to the sum of a luminescence threshold voltage and a modulation voltage;

a second voltage supply unit for generating the luminescence threshold voltage;

a relative potential difference generating unit for directly receiving an input clock signal in the delayed and inverted form and switching the output voltages from the first and second voltage supply units to perform AND and OR operations for the voltages, thereby generating a column electrode voltage, a reference voltage and a row electrode voltage;

a pair of drive integrated elements having a push-pull structure and respectively adapted to receive the column electrode voltage and the reference voltage from the relative potential difference generating unit, perform a push-pull operation in accordance with an input gate signal, and thereby output the column electrode voltage; and another drive integrated element having an open-drain structure and adapted to receive the row electrode voltage from the relative potential difference generating unit and output the received row electrode voltage in accordance with the input gate signal.

2. A circuit in accordance with claim 1, wherein the relative potential difference generating unit comprises:

a RC delay unit for delaying an input clock signal for a predetermined time;

a first inverter for inverting an output signal from the RC delay unit;

a second inverter for inverting the input clock signal;

a reference voltage generating unit for receiving both the input clock signal and an output signal from the first inverter, performing switching operations respectively based on the received signals, generating alternating current voltages each ranging in a level from the luminescence threshold voltage to a ground voltage, respectively by the switching operations, ORing the generated voltages, and thereby generating a reference voltage;

a column electrode voltage generating unit for receiving both the input clock signal and the output signal from the first inverter, performing switching operations respectively based on the received signals, generating alternating current voltages each ranging in a level from the voltage corresponding to the sum of the luminescence threshold voltage and the modulation voltage to the ground voltage, respectively by the switching operations, ORing the generated voltages, and thereby generating a column electrode voltage; and a row electrode voltage generating unit for receiving both an output signal from the second inverter and an output signal from the RC delay unit, performing switching operations respectively based on the received signals, generating alternating current voltages each ranging in a level from the voltage corresponding to the sum of the luminescence threshold voltage and the modulation voltage to the ground voltage, respectively by the switching operations, ANDing the generated voltages, and thereby generating a row electrode voltage.

3. A circuit for driving alternating current thin film electroluminescence device using a relative potential difference, comprising:

a. a first voltage switching circuit for switching a drive voltage in accordance with an input clock signal and thereby amplifying it to a level ranging from the drive voltage to a ground voltage, and comprising, a photo coupler adapted to be switched between ON and OFF states in accordance with an input clock signal, a first inverter adapted to invert the input clock signal, and a pair of transistors respectively adapted to be switched between ON and OFF states by output signals from the photo coupler and the inverter while generating voltages ranging in a level from the drive voltage to zero voltage synchronized with the input clock signal;

b. a second inverter for inverting the input clock signal; and c. a second voltage switching circuit for switching the drive voltage in accordance with an output signal from the second inverter and amplify it to a level ranging from the drive voltage to the ground voltage to output a voltage inverted from an output signal from the first voltage switching circuit so that output voltages of the voltage switching circuits are switched to generate their differential voltage.

* * * * *